US006003504A

United States Patent [19]

Rice et al.

[11] Patent Number: 6,003,504

[45] **Date of Patent: *Dec. 21, 1999**

[54] PAINT BALL GUN

[75] Inventors: John Ronald Rice; Nicholas John Marks, both of Stoke-on-Trent, United Kingdom

[73] Assignee: NPF Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 09/137,641

[22] Filed: Aug. 20, 1998

[51] Int. Cl.[6] ..... F41A 19/00

[52] U.S. Cl. ..... 124/73; 124/75; 124/77

[58] Field of Search ..... 124/77, 73, 74, 124/75

[56] References Cited

U.S. PATENT DOCUMENTS

| | | | |
|---|---|---|---|
| 4,770,153 | 9/1988 | Edelman | 124/72 |
| 5,280,778 | 1/1994 | Kotsiopoulos | 124/73 |
| 5,727,538 | 3/1998 | Ellis | 124/77 |

OTHER PUBLICATIONS

"What an Angel"(article re Angel V6 Gear Special), PGI product catalog, pp.74–75.

*Primary Examiner*—J. Woodrow Eldred
*Attorney, Agent, or Firm*—Christie, Parker & Hale, LLP

[57] ABSTRACT

A paint ball gun is connected through a first gas pressure regulator to a supply of pressurised gas for maintaining a high gas pressure in a first chamber in the gun and a second gas pressure regulator is connected between the first chamber and a second chamber in the gun to maintain a working gas pressure in the second chamber greater than atmospheric pressure but less than the gas pressure in the first chamber. A pneumatic control valve is arranged to receive gas under pressure from the second chamber and direct it selectively to a pneumatic ram mounted for sliding movement in a cylinder in the gun between a retracted position and a forward position in which it opens a valve to admit high pressure gas from the first chamber to the barrel to fire a paint ball. An electrical switch for the control valve is connected to an electronic control circuit which incorporates a micro-switch operated by the trigger of the gun.

20 Claims, 5 Drawing Sheets

PAINT BALL GUN

FIELD OF THE INVENTION

The invention relates to a compressed gas powered gun for firing marking pellets or paint balls.

BACKGROUND OF THE INVENTION

A variety of guns using discharged compressed gas for firing relatively fragile projectiles are known employing manual, semi-automatic, and fully automatic arrangements. Compressed gas powered guns are typically useful as pellet marking guns, commonly called paint ball guns. Paint ball guns have attained widespread use in a recreational sport known as paint ball or war games. Typically located in open spaces with varying types of terrain, opposing sides employ guerilla-type strategy to seek out and "kill" one another by marking the opposition with a paint ball which is fired from a gun and bursts on impact.

Paint ball guns use compressed gas to fire a gelatinous capsule containing a marking material. The marking capsules (paint balls) typically enclose a mixture of water and vegetable coloring so they are not toxic and can be removed from clothing and other surfaces with simple water washing. The capsule breaks on impact with the target dispersing the material to mark the target, for example an opposing player, where hit by the capsule. However, the marking capsule must have sufficient rigidity to avoid breakage during loading and fire operations of the gun.

In U.S. Pat. No. 5,280,778 (Kotsiopoulos) a compressed gas powered gun is disclosed having a semi-automatic firing mechanism for enabling successive firing sequences. The firing mechanism includes a sear having a latch arm, with a cam at one end and an interlocking element at the other end. The cam is positioned to close a firing chamber as the latch arm is rotated. The interlocking element is positioned to concomitantly release an actuating bolt as the latch arm is rotated. A recoil spring repositions the actuating bolt for engagement with the interlocking element upon discharge of the firing chamber.

Operation of the trigger of this gun first releases the hammer to fire a paint ball and subsequently switches a valve to re-cock the gun. Thus correct operation requires these two stages to achieve correct operation of the trigger. The timing of these two stages is also dependent upon the speed of trigger operation.

SUMMARY OF THE INVENTION

The present invention provides a compressed gas paint ball gun in which the operating cycle is tripped by a trigger operated micro-switch and is subsequently controlled by a programmed electronic control circuit. This avoids the possibility of the cycle not being properly completed or being started again before it has been properly completed.

The present invention provides a paint ball gun which has a first pressurised gas circuit for delivering pressurised propellant gas from a supply to the barrel of the gun. A valve in the first pressurised gas circuit is opened by a pneumatic device which is itself powered from a second pressurised gas circuit feeding from the same supply. A programmed electronic control circuit including a timer operates the pneumatic device. The electronic control device is actuated to begin the firing cycle by means of a switch connected to the trigger of the gun.

BRIEF DESCRIPTION OF THE DRAWINGS

An embodiment of the invention is described below by way of example with reference to the accompanying drawings, in which.

DETAILED DESCRIPTION OF THE PREFERRED EMBODIMENT

Figure 1:
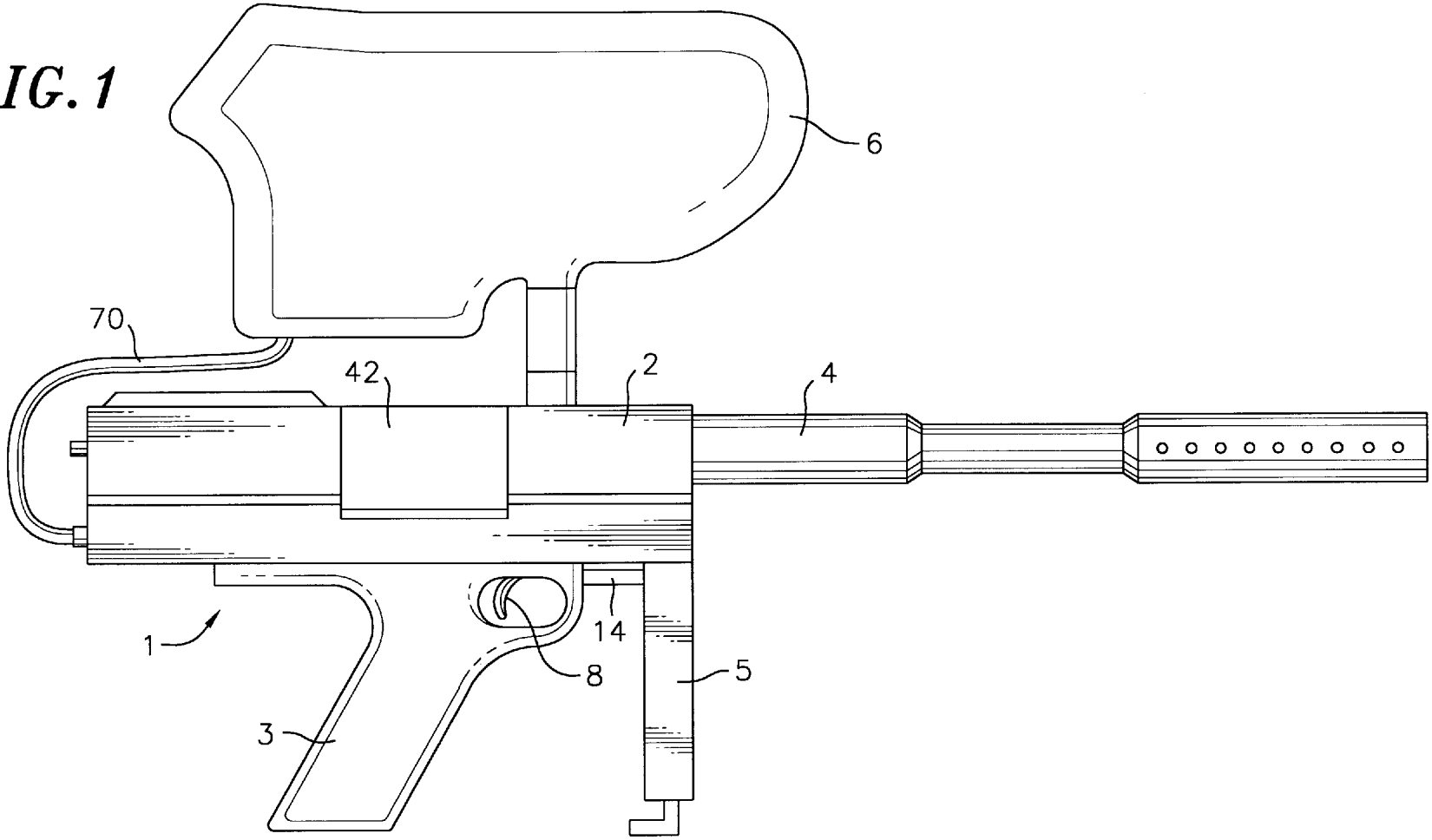
FIG. 1 is a side view of a paint ball gun with a hopper attached.

Referring to the drawings it can be seen that the gun 1 has a main body 2, with a grip frame 3, a barrel 4 and a gas inlet regulator body 5 attached. A paint ball hopper 6 can be mounted on the top of the main body 2.

The grip frame 3 houses an electronic circuit board 7 which carries an electronic programmed control circuit for the gun including a programmed integrated circuit (PIC) 77, a pivotally mounted trigger 8 and a micro-switch 9 for the control circuit which is actuated by the trigger 8. The electronic control circuit is part of an electric circuit for the gun which is powered from a battery 10 housed in the main body 2 through an isolator switch 11. The electronic control circuit has a fixed cycle of operation which is governed by a timer.

The gun uses a gas propellant and a source of pressurised gas such as compressed air at about 800–850 psi must be connected to the inlet 12 of the regulator body 5 either directly or through a supply line. The body 5 houses a gas pressure regulator which controls the gas pressure within the body chamber 13 to about 400–600 psi. Chamber 13 is connected by a pipe 14 and a passageway 15 to a high pressure chamber 16 in the gun body. Chamber 16 is formed in an generally cylindrical bore 17 running the length of the main body 2 and is closed at one end by a bang valve or poppet valve 18 and at the other end by a second gas pressure regulator 19. When the poppet valve is opened it connects the chamber 16 with the barrel of the gun as described below to form a first pressurised gas circuit for delivering pressurised propellant gas from the supply to the barrel of the gun for propelling paint balls therefrom. The second regulator 19 is a low pressure regulator which bleeds off "low pressure" gas at about 80–90 psi from the high pressure chamber for use in a second pressurised gas circuit which forms the pneumatic control circuit of the gun to be described below.

Figure 3:
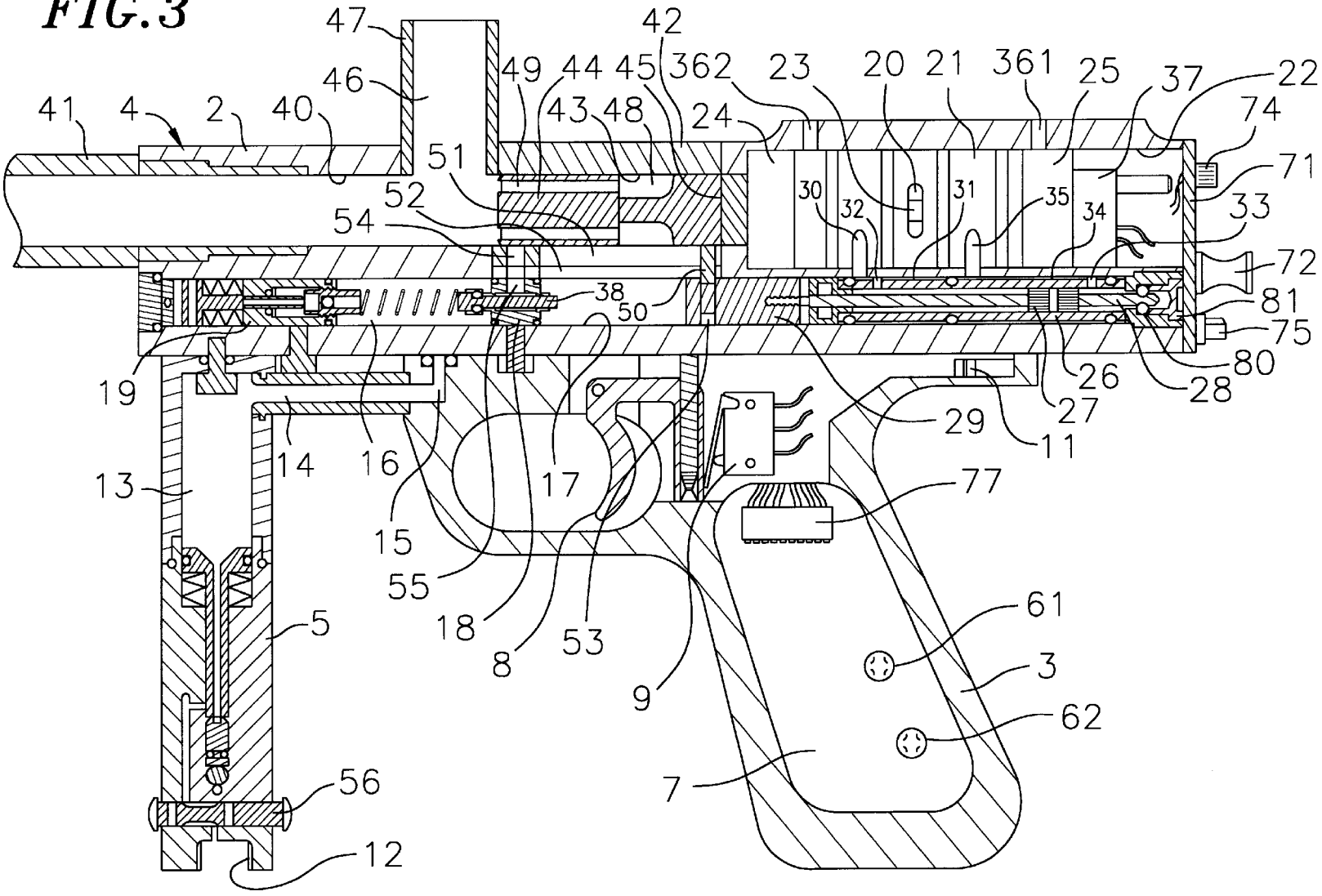
FIG. 3 is a sectional view through the paint ball gun in a first condition.

The low pressure gas is conducted from the left hand end of the regulator 19 (as seen in FIG. 3) through a drilled bore in the body 2 and fed to the inlet 20 of a control valve in the form of a spool valve 21 mounted in a cylindrical bore 22 in the housing 2. The spool valve 21 has a spindle 23 and a pair of servos 24, 25 mounted at either end of the valve to act on the spindle. A boring in the spool valve delivers the low pressure gas to both of the servos but because servo 25 is more powerful than servo 24, it normally urges the spindle 23 to the left in FIG. 3.

A pneumatic ram having a cylinder 26 is mounted in the cylindrical bore 17 generally beneath the spool valve 21. The ram has a piston 27 mounted on a rod 28 for sliding movement in the cylinder 26 and a ram head 29 mounted on one end of the rod 28 for sliding movement therewith in the bore 17.

The right hand end of the rod 28 has a notch by means of which it is releasably held in an adjustable clamp comprising an O-ring 80 and an adjusting screw 81.

When the spool valve 21 is in the rest position shown in FIG. 3, low pressuregas supplied to the valve 21 is directed through valve outlet 30, a space 31 and a port 32 to the cylinder on the left hand side of piston 27 to urge the ram to the retracted position shown in FIG. 3. In this position, the cylinder to the right of the piston is vented through a port 33, a space 34, valve outlet 35 and a vent valve 361.

Figure 4:
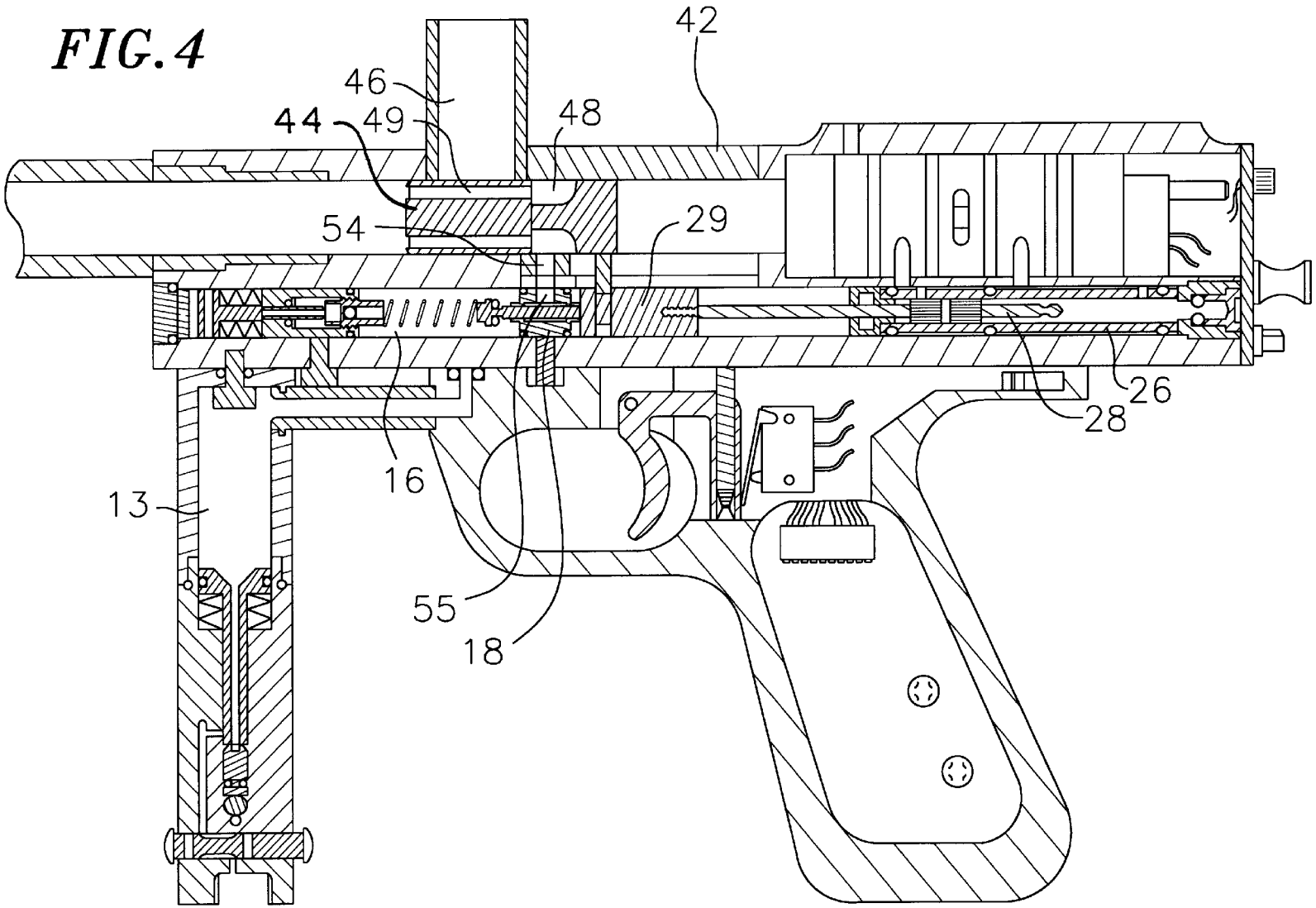
FIG. 4 is a sectional view through the paint ball gun in a second condition.
Figure 5:
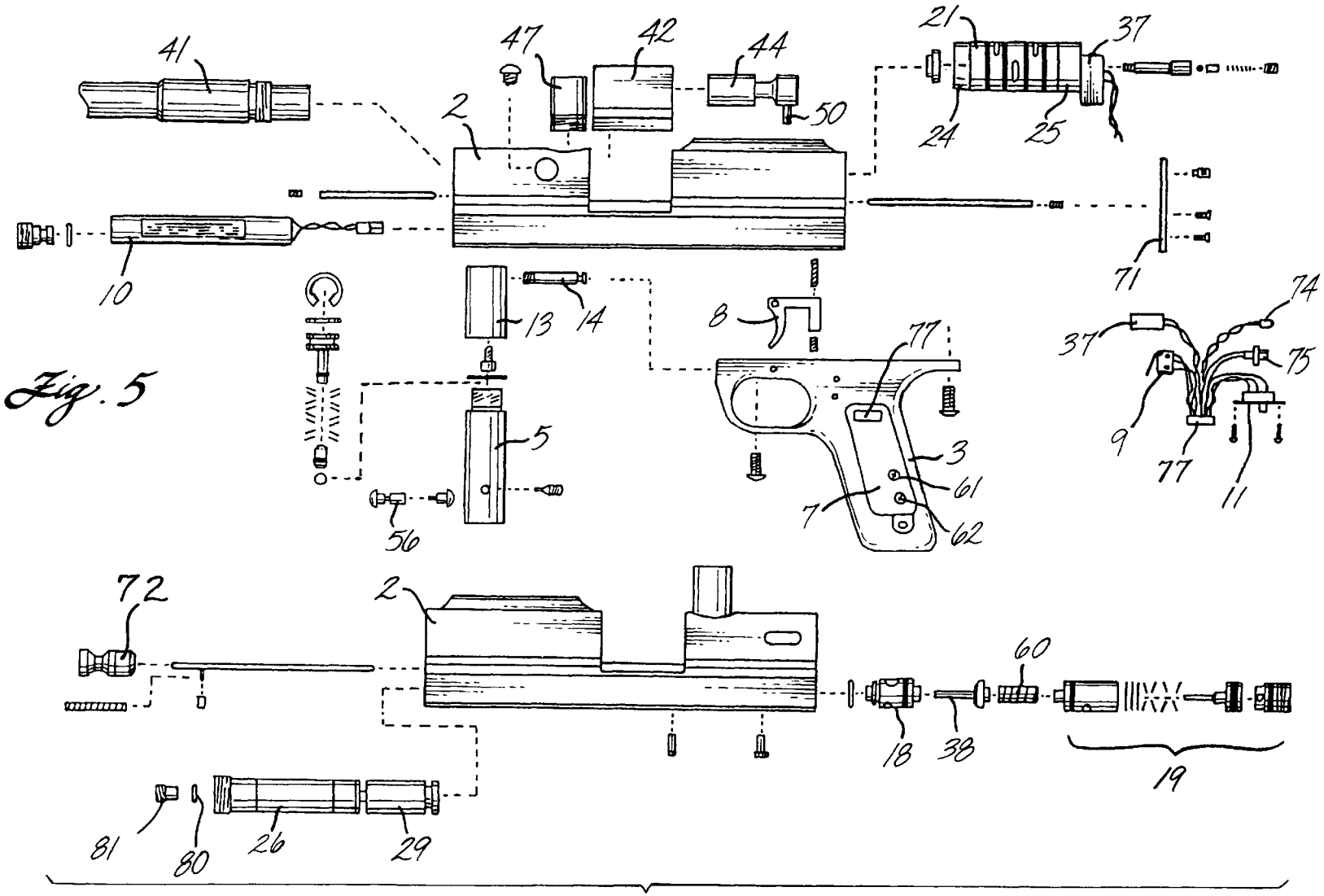
FIG. 5 is an exploded side view of the components of the gun.

An electrical solenoid switch is mounted on the servo 25 and can be actuated by the electronic control circuit of the gun to vent the servo 25 to atmosphere. In this condition, servo 24 prevails to move the spindle 23 of the valve 21 to the right in FIG. 3. In this position the low pressure gas supply is directed through valve outlet 35, space 34 and port 33 to the cylinder 26 onto the right of the piston in FIG. 3 to move the ram to the left in FIG. 3 towards its forward position shown in FIG. 4 where the ram head 29 engages the poppet 38 of the poppet valve 18 to open the poppet valve. The left hand end of cylinder 26 is vented at this time through port 32, space 31, valve outlet 30 and a further vent valve 362.

Figure 2:
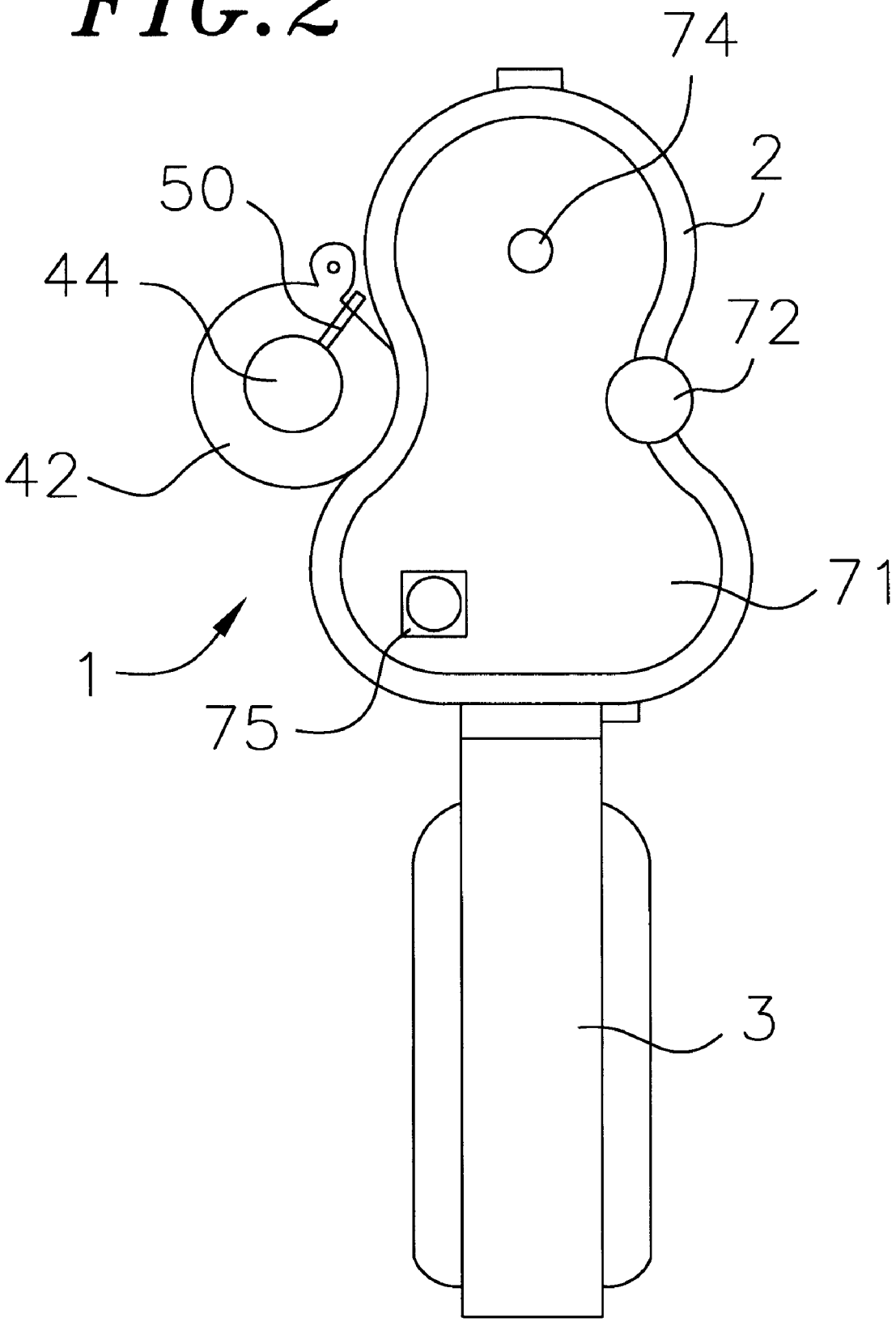
FIG. 2 is a rear view of the paint ball with the hopper removed and the breech in the open position.

The barrel 4 of the gun comprises a cylindrical bore 40 in the main body 2 coaxial with the bore 22 and a barrel extension 41 which is screwed into the bore 40. A breech block 42 is pivotally mounted on the main body 2 between a closed position shown in FIGS. 1, 3 and 4 and an open position shown in FIG. 2. The block 42 has a cylindrical bore 43 which is aligned with the bore 4 when the breech is closed and forms the rearmost part of the barrel 4. A bolt 44 is mounted in the breech block 42 for sliding movement in the barrel between the retracted position shown in FIG. 3 in which it lies between the closed end 45 of the barrel 4 and a paint ball inlet 46 and a forward position shown in FIG. 4 in which it closes the inlet. The inlet 46 is provided by a pipe 47 which is screwed into the main body 2 and extends vertically upwardly to connect to the hopper 6.

The bolt 44 is generally cylindrical and is formed with an annular groove 48 and a plurality of axially extending bores 49 connecting the forward end of the bolt with the groove 48. A pin 50 mounted on the rearward end of the bolt extends through a slot 51 in the breech block 42 and a slot 52 in the main body 2 into the cylindrical bore 12 where it locates in an annular grove 53 in the ram head 29. Thus the bolt is coupled to the ram for movement therewith. Aligned ports 54 and 55 in the breech block 42 and the main body 2 connect the bore 43 with the inside of the poppet valve.

Operation of the gun is as follows.

With a source of high pressure gas connected to the inlet 12 of the gas inlet regulator body 5 and the on/off pin 56 pushed to the "on" position shown in FIG. 3, a high pressure gas charge exists in body chamber 13 and high pressure chamber 16. Once the electrical switch 11 has been put to the "on" position, the gun is ready to fire. A paint ball fed down from the hopper 6 will be located in the barrel adjacent the front end of the bolt 44 which will be in the retracted position shown in FIG. 3. When the trigger 8 is pulled, it operates the micro-switch 9 to actuate the electronic control circuit 7 and start the timer for the electronic control cycle. The electronic control circuit actuates the solenoid switch 37 to vent the servo 25. Servo 24 then moves the spindle of the spool valve 21 so that low pressure gas is delivered to the cylinder 26 to the right of the piston 27 and pressure in that part of the cylinder begins to build. The right hand end of the rod 28 is initially held in the adjustable clamp but when the pressure in the cylinder 26 to the right of the piston 27 reaches a predetermined level, the rod is released from the clamp and the ram can move to the left in FIG. 3; the cylinder space to the left of the piston 27 now being vented to atmosphere.

The ram slides rapidly to the left until the ram head 29 strikes the foot of the popper 38 of the poppet valve 18 to lift it from its seat and connect the high pressure chamber with the breech block through the valve 17 and aligned ports 54, 55. This is the "firing" position shown in FIG. 4. As the ram moves to its forward position, it carries the bolt 44 along with it. Thus the bolt 44 slides within the bore 4 as the ram advances, pushing the waiting paint ball past the inlet 46 and closing off the inlet. When the ram head 29 opens the poppet valve 17, the annular groove 48 in the bolt is aligned with ports 54, 55 and high pressure gas thus passes into the barrel 4 through the groove 48 and the bores 49 to propel the paint ball along the barrel and out of its free end.

After the poppet valve has been momentarily opened by being struck by the ram head 29 it closes under the action of gas pressure and a return spring 60, pushing the ram back a small way (about 1 mm) along the bore 17 where it is held by the low pressure gas acting in the cylinder 26.

The bolt remains in the forward position until the timer in the electronic control circuit actuates the solenoid switch 33 to close the vent of the servo 25. Servo 25 moves the spool valve spindle to the left in FIG. 3 and gas pressure is directed through the spool valve to the left side of the piston 27 to return the ram to its retracted position shown in FIG. 3. The timer is set to return the ram and the bolt 44 to the retracted position just as the paint ball is leaving the barrel. At this point, a slight negative pressure exists in the barrel adjacent its closed end and as the bolt retracts back past the inlet 46, this negative pressure acts to help draw the next succeeding paint ball waiting in the pipe 47 into the barrel 4. Once a further preset minimum time period has elapsed after the operation of the solenoid switch to return the ram and bolt to their retracted positions, the cycle of the electronic control system is completed and the electronic control circuit can be operated again by means of the trigger 8 to fire the next paint ball. A control knob 61 on the circuit board can be used to adjust the period of the cycle of the control circuit to vary the length of the cycle and thus the maximum number of shots which can be fired per second. This can normally be varied between about 5 and 15 shots per second. The point within the cycle at which the bolt is withdrawn can also be adjusted by means of a second control knob 62.

The electronic timing of the return of the bolt means that a disadvantage found in prior paint ball guns, where residual pressure in the barrel tends to blow the next succeeding paint ball back towards the hopper, is avoided. This has enabled the feed pipe 47 in the present gun to be vertical whereas in prior guns it has been necessary for the feed pipe to enter the barrel from the side.

The hopper 6 is provided with an electrically driven stirring mechanism. A cable 70 from the hopper to a socket 75 on the gun 1 connects the stirring mechanism to the electric circuit of the gun so that its operation can be controlled by the electronic control circuit. Advantageously the stirring mechanism is actuated whenever the gun is first switched on and at any time when the firing rate of the gun exceeds a predetermined rate such as two shots per second.

As described, the gun is set up for semi-automatic operation but it can readily be converted to select fire or fully automatic operation in which the electronic control circuit continuously repeats the firing cycle whilst the trigger is actuated. In this case the rate of fire will depend solely on the length of the firing cycle.

An LED 74 mounted on an end plate 71 warns the user that the gun is switched on. The end plate covers bores 17 and 22 and a further cylindrical bore parallel to both bores 17, 22 which houses the battery 10. A knob 72 adjacent the end plate is pulled to release a catch holding the breech block 42 in the closed position. The end plate also supports the socket 75 which, apart from providing a power connection for the hopper stirring mechanism, can also be used as a charging socket for the battery 10. Removal of the end plate gives access to the adjusting screw 81 of the piston rod clamp.

It should be understood that the term "low pressure" is used herein to refer to a working gas pressure which is generally lower than the high gas pressure used to fire the paint balls but is nevertheless a positive pressure higher than atmospheric pressure. The "high" pressure required in chamber 16 decreases if the size of the chamber is increased and although a high pressure is not needed in the pneumatic control circuit, there is nothing to prevent a high pressure being used. Thus whilst it is preferred that the first pressurised gas circuit will be at a higher pressure than the second pressurised gas circuit as described, this is not essential and the two circuits could run at the same pressure.

What is claimed is:

1. A paint ball gun comprising:

a first pressurised gas circuit for delivering pressurised propellant gas from a supply to a barrel of the gun for propelling paint balls therefrom, the first pressurised gas circuit including a valve;

a second pressurised gas circuit connected to the gas supply to receive gas therefrom, the second pressurised gas circuit comprising a pneumatic ram, and a pneumatic valve for driving the pneumatic ram in sliding movement in the gun between a retracted position and a forward position in which it strikes the valve in the first pressurised gas circuit to open it and a clamp for holding the pneumatic ram in the retracted position until sufficient gas pressure has built up for the pneumatic ram to overcome the clamp;

an electric circuit adapted to operate the pneumatic valve; and a trigger connected to the electric circuit to operate it.

2. A paint ball gun as claimed in claim 1, wherein the electric circuit has a programmed and timed cycle which is initiated by operation of the trigger.

3. A paint ball gun as claimed in claim 1 further comprising a breech block pivotally mounted on the gun between a closed position in which a bore in the breech block is aligned with the barrel of the gun and an open position in which the bore in the breech block is parallel to but spaced from the barrel of the gun.

4. A paint ball gun as claimed in claim 3, wherein a bolt mounted for sliding movement in the breech block and the barrel of the gun can be removed from the breech block when the breech block is pivoted to its open position.

5. A paint ball as claimed in claim 4, wherein when the breech block is in the closed position, the bolt is coupled to the pneumatic ram.

6. A paint ball gun comprising:

a battery connected to an electronic programmed control circuit;

a trigger mounted to operate a micro-switch to actuate the control circuit;

means for connecting the gun through a first gas pressure regulator to a supply of pressurised gas for maintaining a first gas pressure in a first chamber in the gun;

a second gas pressure regulator connected between the first chamber and a second chamber in the gun to maintain a second gas pressure in the second chamber;

a pneumatic ram mounted for sliding movement in a cylinder in the gun;

a control valve arranged to receive gas under pressure from the second chamber and direct it selectively to a first side or the second side of a pneumatic ram for driving the ram between a retracted position and a forward position;

a clamp for holding the pneumatic ram in the retracted position until sufficient gas pressure has built up on the first side of the pneumatic ram to overcome the clamp;

an electrical switch for the control valve connected to the control circuit;

a gun barrel having a closed end and an open end and having an inlet for paint balls adjacent the closed end;

a gas passage between the first chamber and the gun barrel at a point between the closed end thereof and the paint ball inlet; and a valve in the gas passage adapted to be opened by engagement by the ram when the ram is in its forward position to permit the passage of pressurised gas from the first chamber to the barrel to propel a paint ball along the barrel and out of the open end thereof.

7. A paint ball gun as claimed in claim 6, further comprising a bolt mounted for sliding movement in the barrel from a retracted position in which it lies between the closed end of the barrel and the paint ball inlet and a forward position in which it closes the paint ball inlet; wherein the bolt is coupled to the ram for movement therewith.

8. A paint ball gun as claimed in claim 7, wherein the bolt is formed with gas passages so that when it is in the forward position, pressurised gas can pass through the bolt to propel a paint ball along the barrel.

9. A paint ball gun as claimed in claim 6, wherein the electronic control circuit operates the electrical switch for the control valve on actuation of the micro-switch to operate the control valve to direct gas under pressure to the first side of the ram to advance the ram to the forward position and wherein the electronic control circuit incorporates a timer to operate the electrical switch for the control valve to operate the control valve to direct gas under pressure to the second side of the ram to return the ram to its retracted position a predetenmined time after actuation of the micro-switch.

10. A paint ball gun operable to fire paint balls, the gun comprising:

a barrel;

a breech coaxial with the barrel;

a bolt moveable between a retracted position in which it is located in the breech and a forward position in which it extends out of the breech and into the barrel; and a pneumatic circuit for controlling the movement of the bolt and including a pneumatic ram coupled to the bolt for dricing the bolt between its retracted position and a forward positon, a control valve arranged to receive gas under pressure and direct it selectively to a first side or a second side of the pneumatic ram and a clamp for holding the pneumatic ram in the retracted position until sufficient gas pressure has built up on the first side of the pneumatic ram to overcome the clamp; and an electronic circuit for controlling the pneumatic circuit;

wherein the electronic circuit includes a timer operative to cause the pneumatic circuit to move the bolt from the forward position to the retracted position at a predetermined time after operation of the gun to fire a paintball.

11. A paint ball gun as claimed in claim 10, further comprising a micro-switch for activating the electronic circuit and a trigger for operating the micro-switch.

12. A paint ball gun as claimed in claim 10, further comprising a paint ball feed pipe connected to the barrel adjacent to the breech and extending vertically upwardly from the breech.

13. A paint ball gun as claimed in claim 9, wherein the electronic control circuit is programmed so that it cannot be operated to fire a subsequent paint ball until a pre-set minimum time period has elapsed after the electrical switch has been operated to return the ram to its retracted position.

14. A paint ball gun as claimed in claim 10, wherein the clamp is an adjustable clamp.

15. A paint ball gun as claimed in claim 14 wherein the pneumatic ram includes a notched rod and the adjustable clamp comprises an O-ring and an adjustment screw, the O-ring adapted to grip the pneumatic ram in the retracted position by the notched rod.

16. A paint ball gun as claimed in claim 6 wherein the clamp is an adjustable clamp.

17. A paint ball gun as claimed in claim 16 wherein the pneumatic ram includes a notched rod and the adjustable clamp comprises an O-ring and an adjustment screw, the O-ring adapted to grip the pneumatic ram in the retracted position by the notched rod.

18. A paint ball gun as claimed in claim 1 wherein the clamp is an adjustable clamp.

19. A paint ball gun as claimed in claim 18 wherein the pneumatic ram includes a notched rod and the adjustable clamp comprises an O-ring and an adjustable screw, the O-ring adapted to grip the pneumatic ram in the retracted position by the notched rod.

20. A paint ball gun comprising:

a first pressurised gas circuit for delivering pressurised propellant gas from a supply to a barrel of the gun for propelling paint balls therefrom, the first pressurised gas circuit including a first pneumatic valve;

a second pressurised gas circuit connected to the gas supply, the second pressurised gas circuit comprising a pneumatic ram, a second pneumatic valve for driving the pneumatic ram from a first position to a second position in which the pneumatic ram strikes the first pneumatic valve to cause the valve to open, and a clamp for holding the pneumatic ram in the first position until sufficient gas pressure has built up.

* * * * *